US011246338B2

(12) United States Patent
Yankelevich

(10) Patent No.: US 11,246,338 B2
(45) Date of Patent: Feb. 15, 2022

(54) DEVICE FOR SMOKING TOBACCO AND OTHER INHALATION MATERIALS

(71) Applicant: Dmitry Yankelevich, Moreland Hills, OH (US)

(72) Inventor: Dmitry Yankelevich, Moreland Hills, OH (US)

( * ) Notice: Subject to any disclaimer, the term of this patent is extended or adjusted under 35 U.S.C. 154(b) by 0 days.

(21) Appl. No.: 16/584,846

(22) Filed: Sep. 26, 2019

(65) Prior Publication Data

US 2021/0195942 A1 Jul. 1, 2021

(51) Int. Cl.
*A24F 1/02* (2006.01)
*A24F 1/32* (2006.01)
*A24F 5/00* (2006.01)

(52) U.S. Cl.
CPC ..... *A24F 1/02* (2013.01); *A24F 1/32* (2013.01); *A24F 5/00* (2013.01)

(58) Field of Classification Search
None
See application file for complete search history.

(56) References Cited

U.S. PATENT DOCUMENTS 305,017 A * 9/1884 Pusey ..... A24F 13/26 131/253
3,847,575 A * 11/1974 Harding ..... A24F 19/14 96/337
2004/0031495 A1* 2/2004 Steinberg ..... A24F 42/60 131/194
2006/0037619 A1* 2/2006 Ishikawa ..... A24C 5/3418 131/280
2013/0074857 A1* 3/2013 Buchberger ..... A24F 42/60 131/329
2013/0269684 A1* 10/2013 Patton ..... A61M 15/0065 128/200.16
2014/0318558 A1* 10/2014 Liu ..... A24F 40/40 131/329
2015/0013696 A1* 1/2015 Plojoux ..... A61M 15/06 131/328

* cited by examiner

*Primary Examiner* — Francisco W Tschen
*Assistant Examiner* — Guy F Mongelli
(74) *Attorney, Agent, or Firm* — Inventa Capital PLC

(57) ABSTRACT

A smoking device includes several parts such as a bottom portion, a core portion, and a slide portion. The device also includes a bowl. The slide portion presents a rectangular plate having a first end, a second end, side edges. The bottom portion includes a bottom surface and a top surface. The top surface includes a pool defined therein to form a depth and a bottom of the pool. The pool presents a meshed surface comprised on a multitude of cavities. The core portion includes a bottom surface and a top surface wherein the width of the top surface is shorter than the width of the bottom surface whereby side walls are straight as they extend from the bottom surface and then incline as they extend to the top surface. When assembled, the bottom surface of the core portion covers the top surface of the bottom portion to cover the pool. The channel having the collector and the passage complemented with the outlet of the bottom portion allow the user to inhale the fume as the fume is cooled while passing through the meshed surface of the pool.

13 Claims, 6 Drawing Sheets

DEVICE FOR SMOKING TOBACCO AND OTHER INHALATION MATERIALS

FIELD OF INVENTION

The present invention relates generally to smoking pipes and more particularly to a pipe having a removable heat resistant bowl.

BACKGROUND OF INVENTION

The history of smoking pipes, mouthpieces, and other smoking devices is as old as the modern human history itself. There is tremendous variety of smoking devices exists across the world including those that were created specifically with the purpose of solving the problem of reducing the temperature of the smoking fumes. It is fair to say that each generation of engineers on the modern era at each new phase of progress has contributed its there own solutions for the above stated problem. Present invention is one more step in this direction.

According to the prior art, a smoking pipe typically includes a bowl attached to a stem. A bore extends through the stem and connects to the bottom of the bowl. The stem may separate from a shank that extends laterally from the bowl and through which the bore extends. Often times the bowl and shank are formed as a single piece and the stem inserts into the shank and is held in this manner by a mortise and tenon connection. The interior of the bowl forms a combustion chamber into which a dried or substantially dry material, tobacco or the like, is packed and then ignited. Smoke is drawn through the bore by the smoker. The difficulty of creating the balance between the natural ability of human lungs to create the pressure drop and desired dosage of smoke intake while inhaling has always been the biggest problem of smoking.

Alluding to the above, many people smoke electronic cigarettes or pipes (hereafter referred to as "e-cig vaporizers"), which are designed to produce mere vapor combustion and aerosol inhalant, which are types of imitation smoke because no ash byproduct is produced. Some users turn to other smoking cessation devices and nicotine alternatives: like chewing tobacco, smokeless nicotine patches, nicotine gums, etc., to satisfy their craving to smoke. There are both, holistic (pipe like) vaporizers and e-cig vaporizers available that can do the same thing as each other, produce mere combustion vapor (i.e., imitation smoke that does not produce ash, or in some cases, vapor, sometimes called combustion smoke, from only slightly burning the plant matter to a point short of incinerating the plant matter to ash). However, there are no self-contained electronic smoking devices that incinerate matter into ash and smoke.

The main factor that is causing just said problem is the temperature of the smoke. From the point of view of Physics, the peculiarity of the smoking process is evident: the same suction effort of smoker that provides a flux of ambient air used for burning the certain amount of smoke-producing material is continuing to carry the produced hot smoke directly into the person's lungs. Delivery of hot gases into the lungs does not only cause a very unpleasant burning sensation and sometimes coughing, but also, according to the majority of modern medical studies, is the main cause of destructive effect that smoking imposes to the human's mouth and lungs. Therefore, the problem of decreasing of the temperature of the hot smoke right at the moment of smoking is the very important goal and the technical challenge.

This is a problem for many former and current smokers of cigarettes and tobacco pipes. Instead of chewing gum or inhaling air from conventional non-incineration electric devices, some people would like to enjoy actual smoke and smoked flavor and aroma. Furthermore, some people prefer not to use external heating sources, which may be difficult to aim and even operate in turbulent conditions, and are flat out dangerous.

To date, however, the only options a person has for smoking with actual smoke and ash includes traditional tobacco smoke products that are externally heated products or internally heated with gas. All other electronic self-contained smoking devices and e-cig vaporizers are not designed to incinerate plant matter thus they are not designed to create actual smoke and ash, but rather, are designed to create types of imitation smoke.

Therefore, what is needed is a self-contained electronic smoking device with an internal heating source (which essentially functions as a cordless, flame-less lighter) and an open interface in which the smoker can fill and refill, like a pipe, and incinerate the packed pipe matter, producing actual smoke and ash, instead of mere combustion vapor or aerosol.

SUMMARY OF THE INVENTION

A smoking device includes several parts such as a bottom portion, a core portion, and a slide portion. The device also includes a bowl. The slide portion presents a rectangular plate having a first end, a second end, and side edges. A pair of openings are formed at the first end, wherein the opening is used to receive the bowl. The bottom portion presents a generally rectangular configuration without limiting the scope of the present invention. The bottom portion includes a bottom surface and a top surface wherein the width of the top surface is wider than the width of the bottom surface whereby the side walls are concave.

The top surface further presents a pool defined therein to form a depth and a bottom of the pool. The pool presents a meshed surface comprised of a multitude of cavities. The pool extends to an outlet defined at a first end of the bottom portion. The outlet presents a semicircular configuration without limiting the scope of the present invention. The core portion includes a bottom surface and a top surface wherein the width of the top surface is shorter than the width of the bottom surface whereby side walls are straight as they extend from the bottom surface and then incline as they extend to the top surface. The core portion includes a first end and a second end. The core portion includes an opening adjacent the first end of the core portion defined therein to fixedly secure a metallic mesh. Those skilled in the art will appreciate that mesh can be fabricated from other materials without limiting the scope of the present invention.

The top surface includes a peripheral rail extending about the top surface except the part at the first end to allow the slide portion to be inserted therein and slide about the top surface wherein the openings are aligned with one another to receive the bowl secured thereby. The bottom surface presents a meshed surface comprised of a second multitude of cavities. A channel is defined at the second end. The channel presents a collector and a passage extending from the collector to complement with the outlet of the bottom portion.

When assembled, the bottom surface of the core portion covers the top surface of the bottom portion to cover the pool. The channel having the collector and the passage complemented with the outlet of the bottom portion allow the user to inhale fume as fume is cooled while passing through the meshed surface of the pool. The bowl includes a bottom portion having a central part and a radial rim extending outwardly from the central portion to define a radial notch to receive the slide portion. The central portion extends further to a base plate having a generally rectangular sides and concave top extending to a central tube portion with a plurality rims of a generally circular configuration.

As the openings are aligned with one another to receive the bowl, the slide portion engages the radial notch to secure the bowl therein during operating mode of the smoking pipe, i.e. the device. A bowl portion is defined on the top of the central tube portion. The bowl portion is formed by a peripheral side wall surrounding the end of the central tube portion wherein oils to be heated fill the voids defined between the peripheral side wall and the central tube portion extending to a central opening fluidly connected with the central portion to allow fumes to enter the device to be inhaled by the user.

The bowl is formed from metal but can be formed from other material without limiting the scope of the present invention. The bowl presents a circular cross section but may also be formed to have a non-circular cross section without limiting the scope of the present invention.

It is the object of present invention to teach the means of using Vortical Boiling Phenomenon of heat exchange at the convective cooling for cooling of smoke inside the smoking pipe up to full recuperation with the temperature of the human body before this smoke has reached the person's lungs.

The invented smoking pipe offers the means for making a full draw of the desired dosage of smoke into the lungs using minimal suction effort. Indeed, when trying to reach the maximum smoking effect a person needs to inhale as much smoke as possible.

The present invention depicts the smoking apparatus which eliminates the need for restrictive airflow by cooling the hot smoke to the human body temperature thus allowing bigger draw of smoke into the lungs and holding it in for longer period of time, therefore increasing the smoking effect.

BRIEF DESCRIPTION OF THE DRAWINGS

Other advantages of the present invention will be readily appreciated as the same becomes better understood by reference to the following detailed description when considered in connection with the accompanying drawings wherein.

Advantages and features of the present invention are better understood with reference to the following more detailed description and claims taken in conjunction with accompanying drawings.

DETAILED DESCRIPTION OF THE INVENTION

Figure 1A:
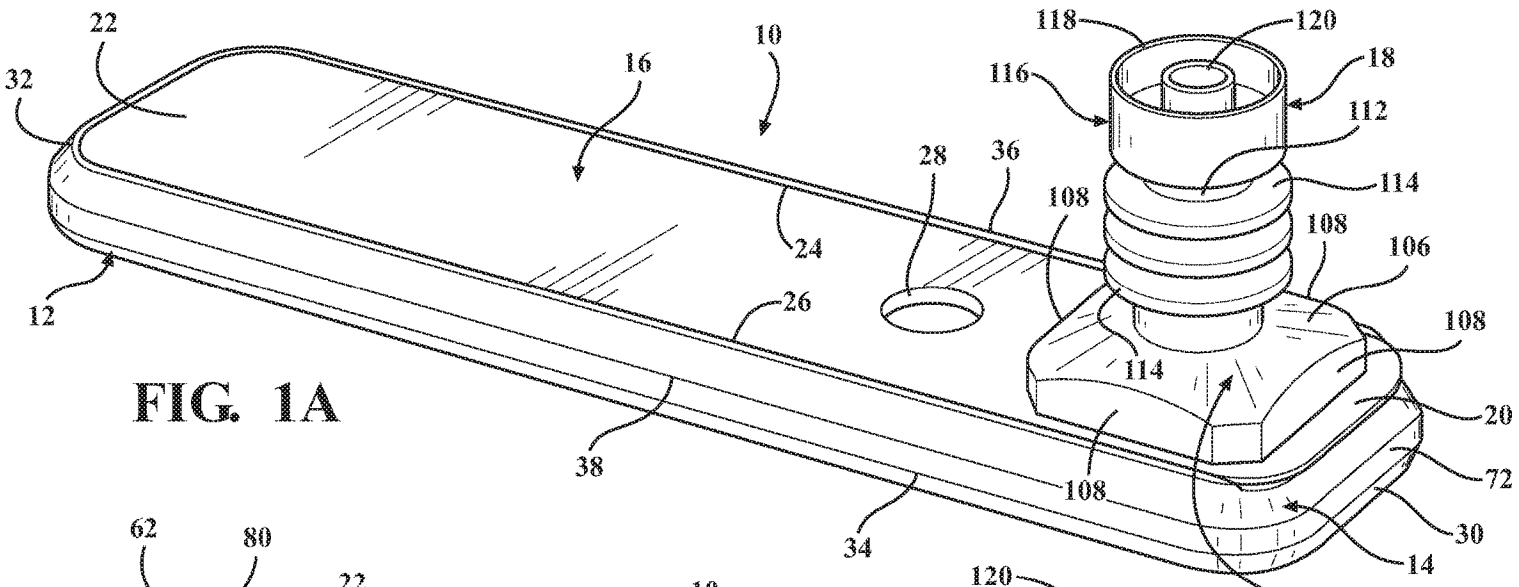
FIG. 1A shows a perspective view of a pipe device and a bowl.
Figure 1B:
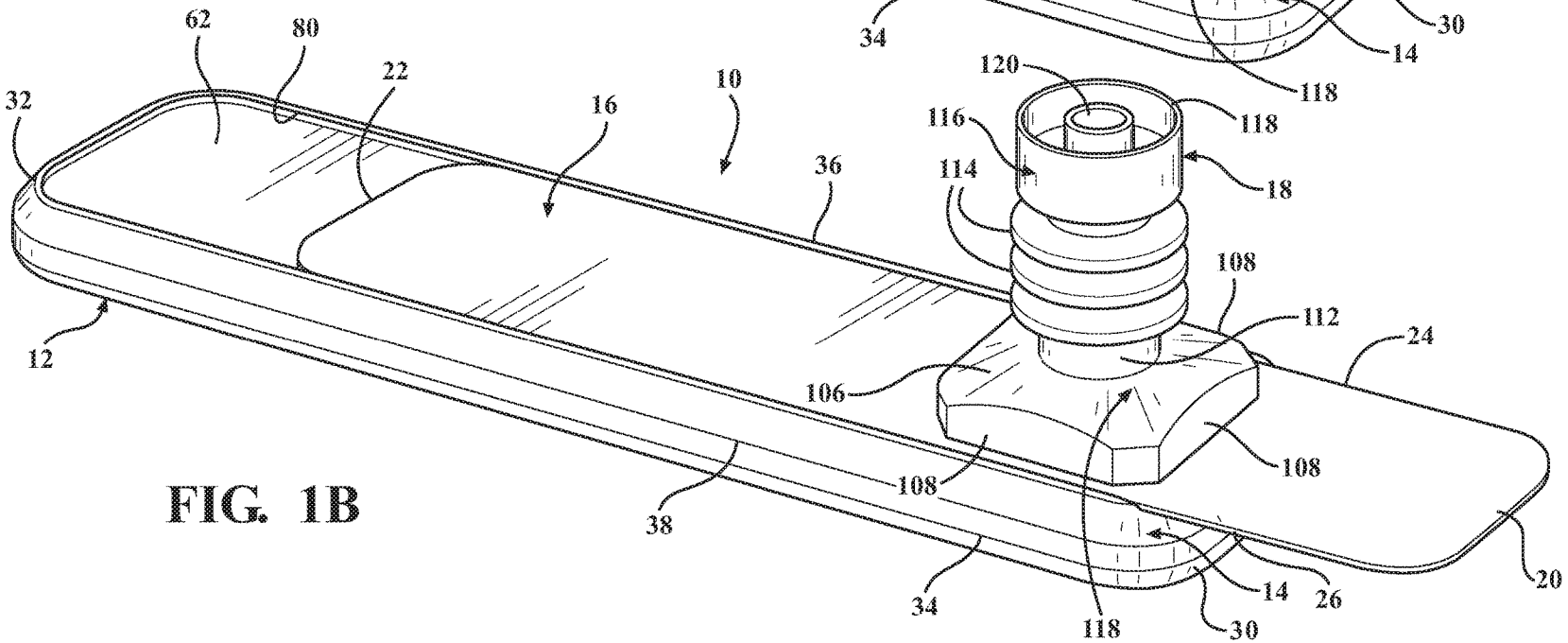
FIG. 1B shows a perspective view of an alternative embodiment of the pipe device with the bowl.
Figure 2:
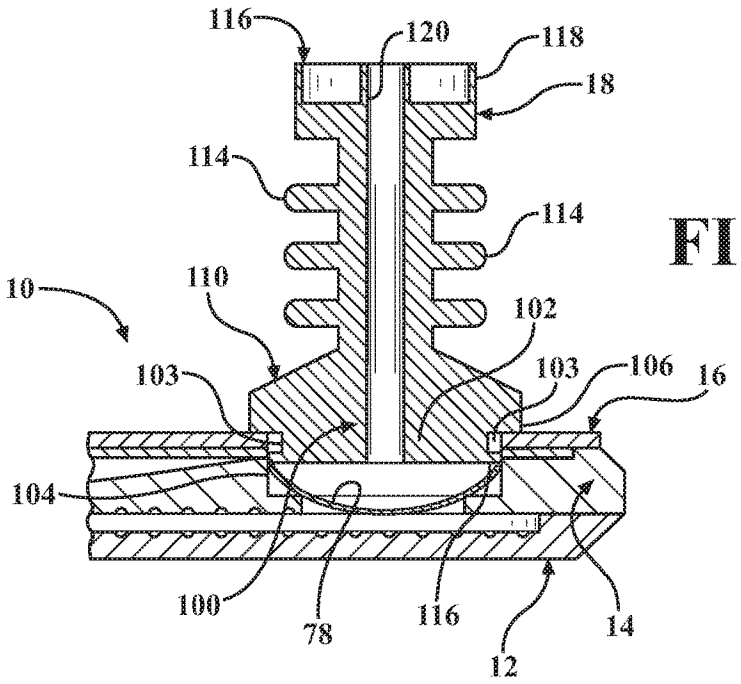
FIG. 2 shows a cross sectional view of the pipe device with the bowl.
Figure 3:
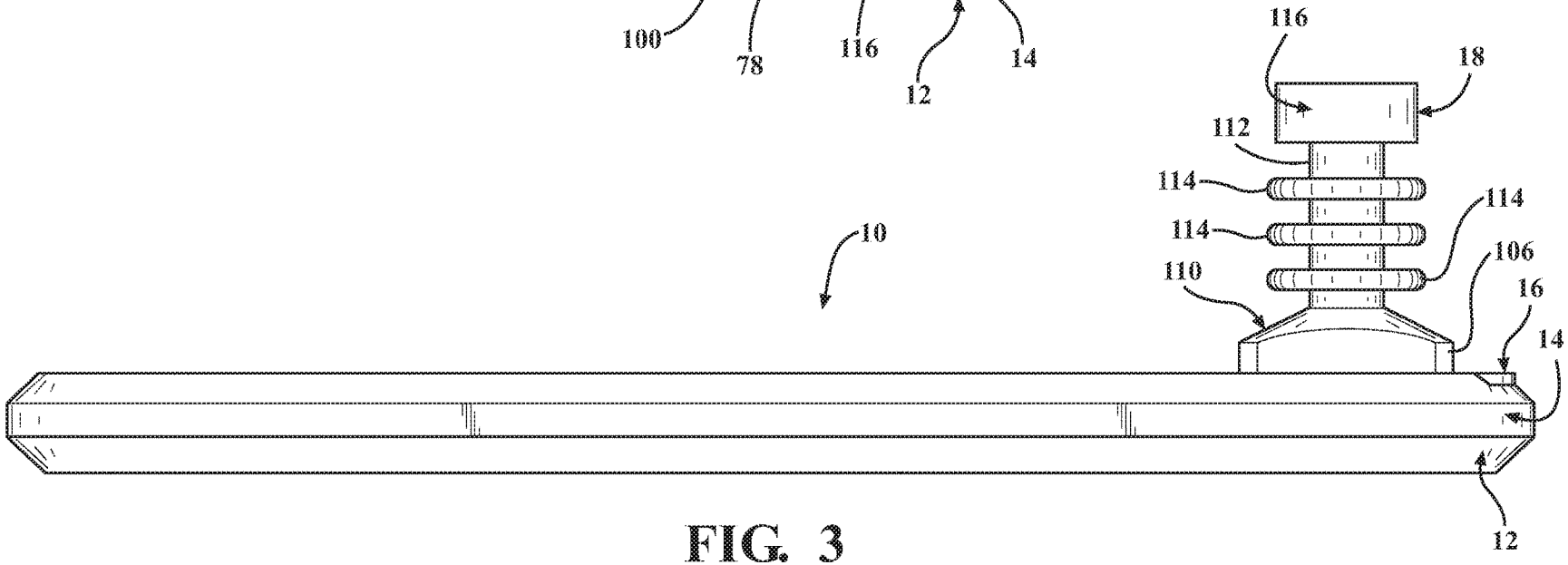
FIG. 3 shows a side view of the pipe device with the bowl.
Figure 4:
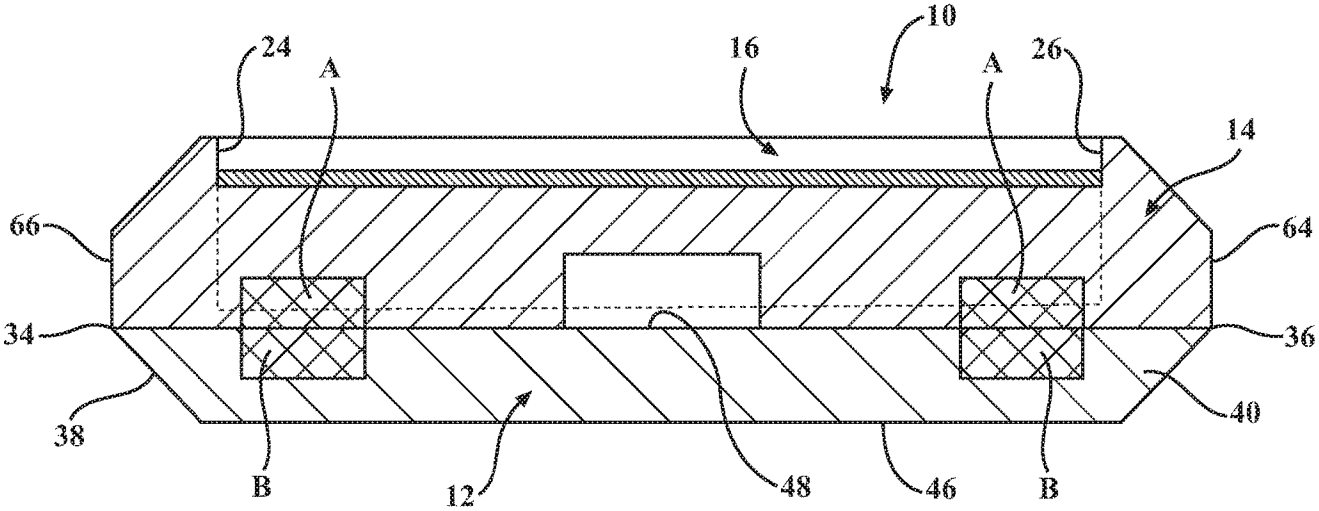
FIG. 4 shows a cross sectional view of the pipe device taken from a front.
Figure 5:
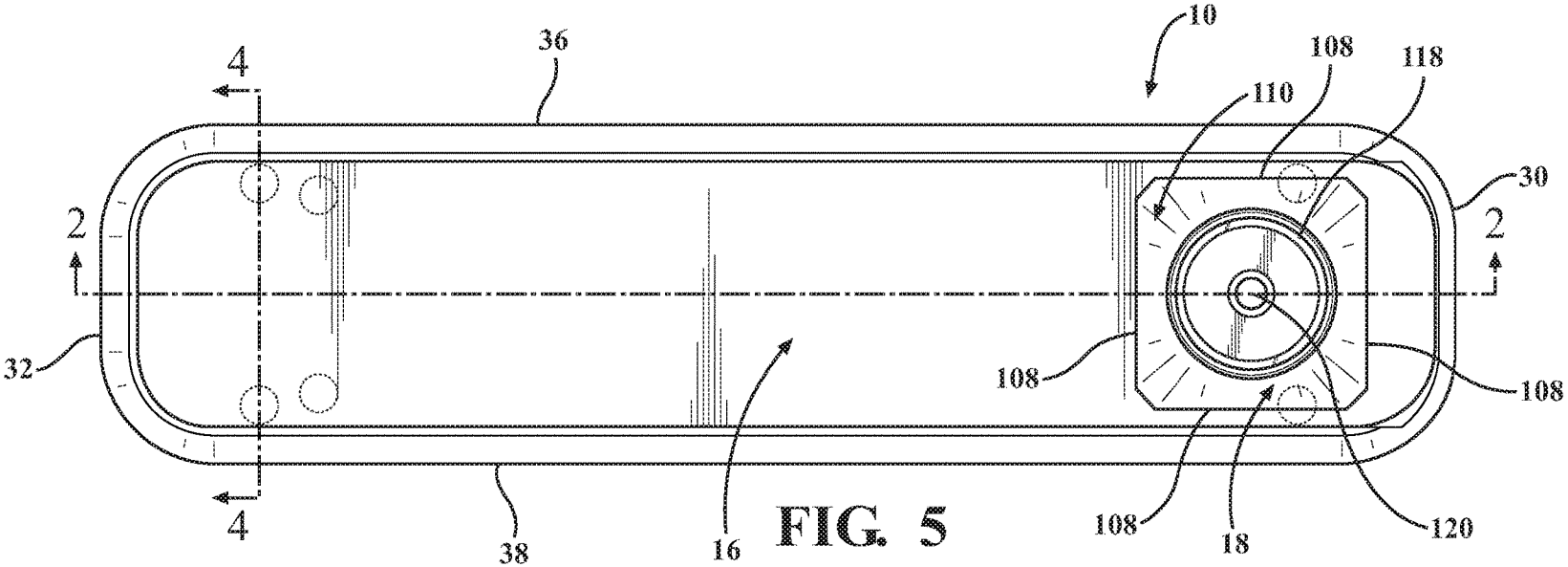
FIG. 5 shows a top view of the pipe device and the bowl of FIG. 1A.

Referring to the Figures, wherein like numerals indicate like or corresponding parts, FIGS. 1A and 1B, for example, illustrate a smoking device of the present invention, generally shown at 10. It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

As shown in FIGS. 1A through 5, the smoking pipe (here and after as the device) is generally shown at 10. The device 10 includes several parts such as a bottom portion, generally indicated at 12, a core portion, generally indicated at 14, and a slide portion, generally indicated at 16. The device also includes a bowl device adaptable for vaporizing (here and after as "bowl" or "bowl element"), generally indicated at 18, and to be described further below.

The slide portion 16 presents a rectangular plate having a first end 20, a second end 22, side edges 24, 26. A pair of openings 28 are formed at the first end 20, wherein the opening 28 is used to receive the bowl 18. The bottom portion 12 includes a first end 30, a second end 32, side edges 34, 36, and side walls 38, 40, 42, and 44. The bottom portion 12 presents a generally rectangular configuration without limiting the scope of the present invention.

Figure 7:
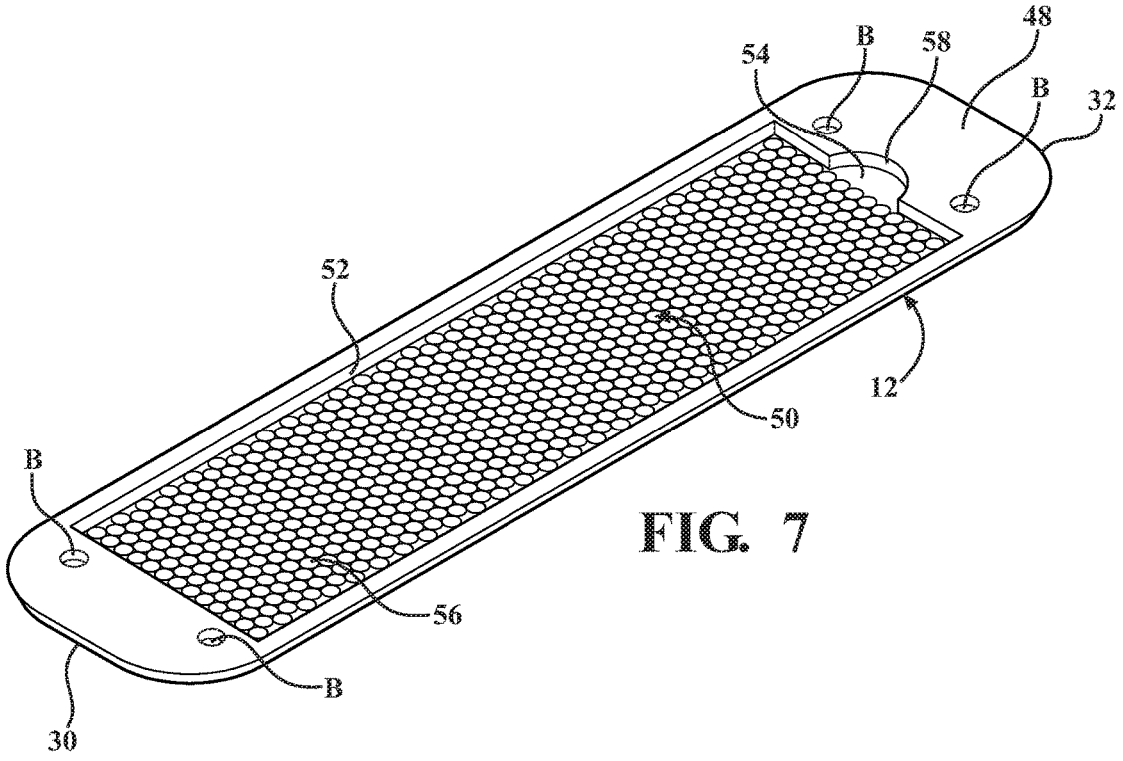
FIG. 7 shows a perspective view of a bottom surface of the bottom portion of the pipe device.

As shown in FIG. 7, the bottom portion 12 includes a bottom surface 46 and a top surface 48 wherein the width of the top surface 48 is wider than the width of the bottom surface whereby the side walls 38, 40, 42, and 44 are concave. The top surface 48 further presents a pool, generally indicated at 50, defined therein to form a depth 52 and a bottom 54 of the pool 50. The pool 50 present a meshed surface comprised on a multitude of cavities 56. The pool 50 extends to an outlet 56 defined at a first end 58 of the bottom portion 12. The outlet 56 presents a semicircular configuration without limiting the scope of the present invention.

Figure 6:
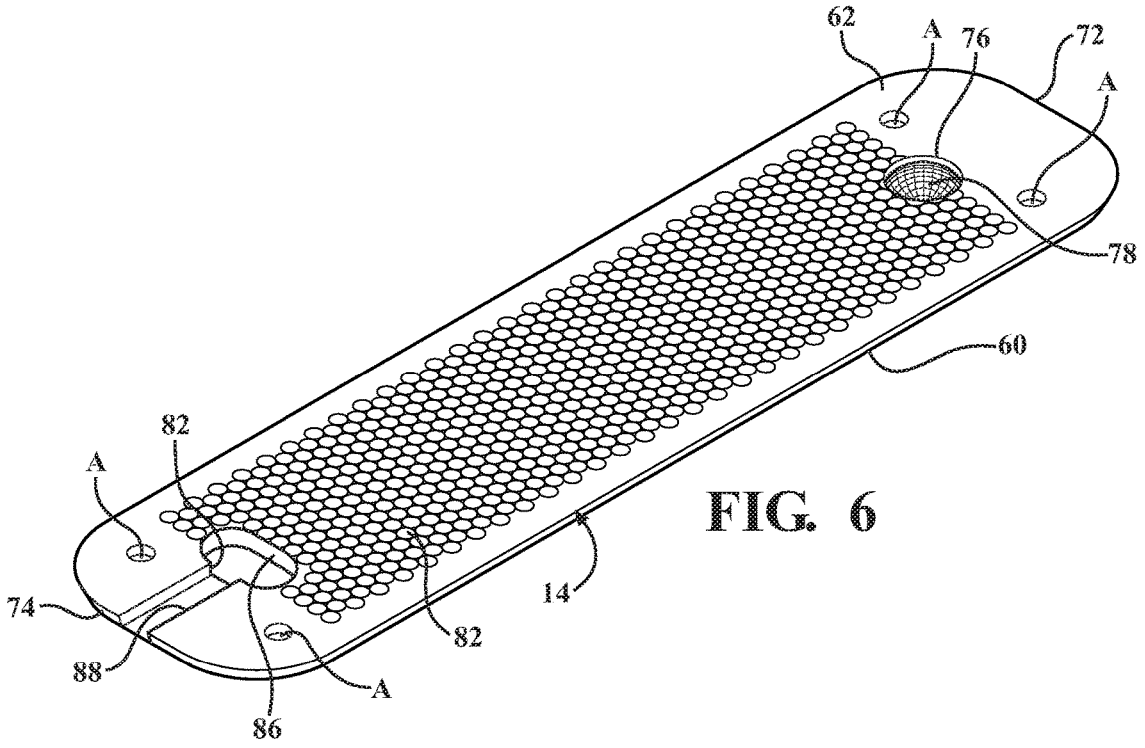
FIG. 6 shows a perspective view of a bottom portion of the core portion of the pipe device.

As shown in FIG. 6, the core portion 14 includes a bottom surface 60 and a top surface 62 wherein the width of the top surface 62 is shorter than the width of the bottom surface 60 whereby side walls 64, 66, 68, and 70 are straight as they extend from the bottom surface 60 and then incline as they extend to the top surface. The core portion 14 includes a first end 72 and a second end 74. The core portion includes an opening 76 adjacent the first end 72 of the core portion 14 defined therein to fixedly secure a metallic mesh 78.

The top surface 62 includes a peripheral rail 80 extending about the top surface 62 expect the part at the first end 72 to allow the slide portion 16 to be inserted therein and slide about the top surface 62 wherein the opening 28 and the opening 76 are aligned with one another to receive the bowl 18 secured thereby. The bottom surface 60 presents a meshed surface comprised of a multitude of cavities 82. A channel 82 is defined at the second end 74. The channel 82 presents a collector 86 and a passage 88 extending from the collector 86 to complement with the outlet 56 of the bottom portion 12.

When assembled, the bottom surface 60 of the core portion 14 covers the top surface 48 of the bottom portion 12 to cover the pool 50. The channel 82 having the collector 86 and the passage 88 complemented with the outlet 56 of the bottom portion 12 allow the user to inhale the fume as the fume is cooled while passing through the meshed surface of the pool 50.

As shown in FIGS. 1A through 3, the bowl 18 includes a bottom portion, generally indicated at 100, having a central part 102 and a radial rim 104 extending outwardly from the central portion 100 to define a radial notch 103 to receive the slide portion 16. The central portion 100 extends further to a base plate 106 having a generally rectangular sides 108 and concave top 110 extending to a central tube portion 112 with a plurality rims 114 of a generally circular configuration. As the opening 28 and the opening 76 are aligned with one another to receive the bowl 18 secured there by as the slide portion 16 engages the radial notch 103 to secure the bowl 18 therein during operating mode of the smoking pipe, i.e. the device 10 thereby forming a mechanical connection to secure the bowl 18 with the slide portion 16, the bottom portion 12 and the core portion 14 and prevent relative movement of the bowl 18.

A bowl portion, generally indicated at 116, is defined on the top of the central tube portion 112. The bowl portion 116 is formed by a peripheral side wall 118 surrounding the end of the central tube portion 112 wherein oils to be heated fill the voids defined between the peripheral side wall 118 and the central tube portion 112 extending to a central opening 120 fluidly connected with the central portion 100 to allow fumes to enter the device 10 to be inhaled by the user. The bowl 18 is formed from metal, metal alloys, or heat resistant materials, but can be formed from other material without limiting the scope of the present invention. The bowl 18 presents a circular cross section, as shown in FIGS. 1A and 1B but may also be formed to have a non-circular cross section without limiting the scope of the present invention.

Figure 8:
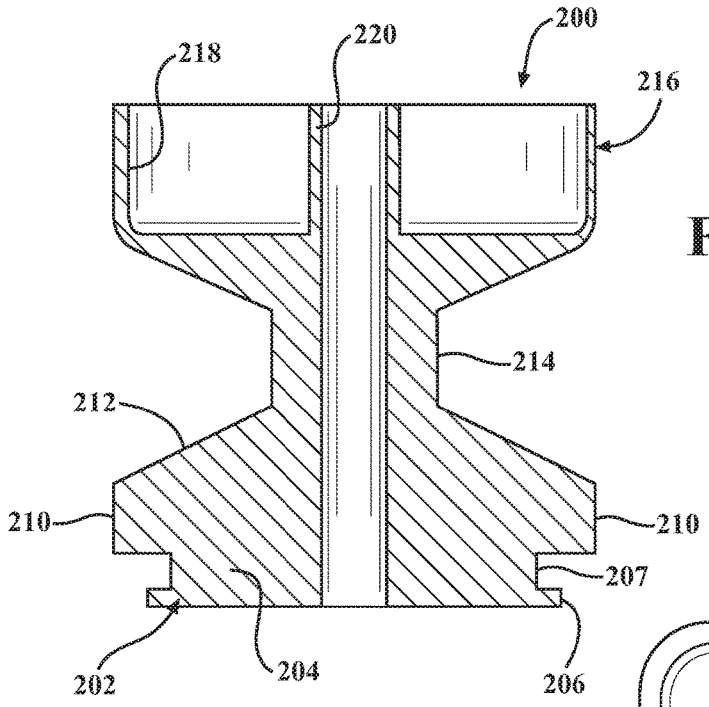
FIG. 8 shows a cross sectional view of an alternative embodiment of the bowl.
Figure 9:
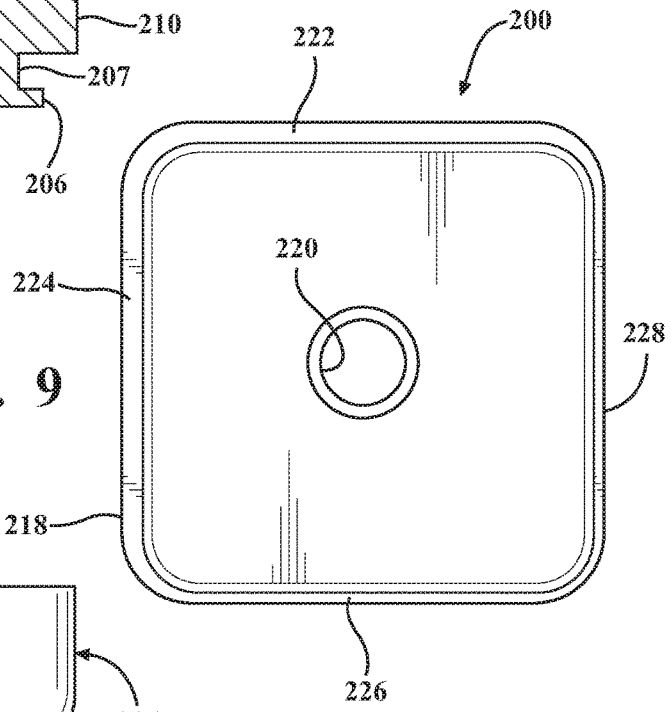
FIG. 9 shows a top view of the bowl of FIG. 8.
Figure 10:
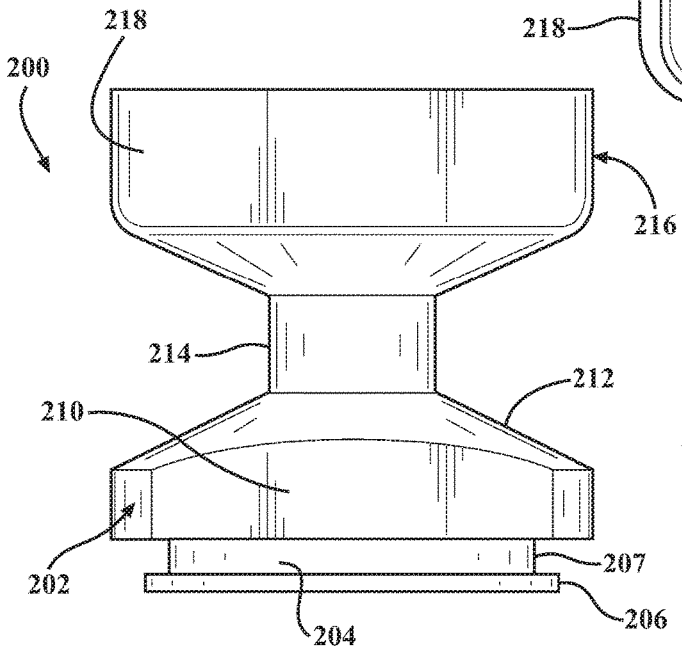
FIG. 10 shows a front view of the bowl of FIG. 8.

As shown in FIGS. 8 through 10, a second alternative embodiment of the bowl is generally shown at 200. The bowl 200 includes a bottom portion, generally indicated at 202, having a central part 204 and a radial rim 206 extending outwardly from the central part 204 to define a radial notch 207 to secure the slide portion 16. A base plate 208 having a generally rectangular sides 210 and concave top 212 extending to a central tube portion 214. As the opening 28 and the opening 76 are aligned with one another to receive the bowl 200 secured there by as the slide portion 16 engages the radial notch 207 to secure the bowl 200 therein during operating mode of the smoking pipe, i.e. the device 10.

A bowl portion, generally indicated at 216, is defined on the top of the central tube portion 214. The bowl portion 216 is formed by a peripheral side wall 218 surrounding the end of the central tube portion 214 wherein oils to be heated fill the voids defined between the peripheral side wall 218 and the central tube portion 214 extending to a central opening 220 fluidly connected with the central portion 202 to allow fumes to enter the device 10 to be inhaled by the user. When in use, the oils are not combusted but rather vaporized at high temperature thus not producing much ash.

The bowl 216 is formed from metal but can be formed from other material without limiting the scope of the present invention. The bowl 200 presents a generally rectangular configuration defining four sides 222, 224, 226, and 228 wherein sides 222 and 224 are thicker than the sides 226 and 228. Uneven thickness of the sides 222, 224, 226, and 228 is designed to manipulate and control temperature of the oil heated inside the bowl 200. The bowl 200 is formed from metal and can also be formed from other materials without limiting the scope of the present invention. The bowl 200 may have a circular configuration as well and the rectangular as shown in FIG. 9 is not intended to limit the scope of the present invention. The circular side wall may have uneven thickness to manipulate and control temperature of the oil heated inside the bowl 200.

Figure 11:
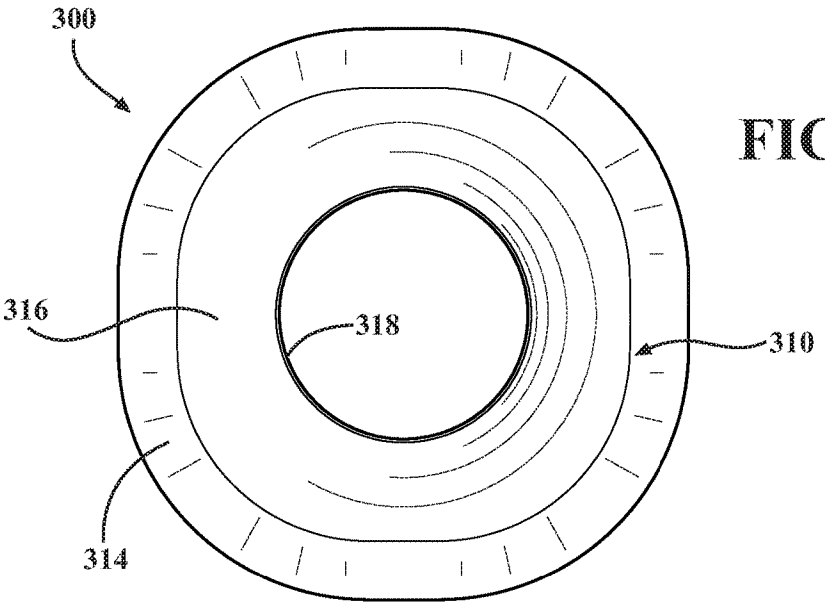
FIG. 11 shows a top view of another alternative embodiment of the bowl element.
Figure 12:
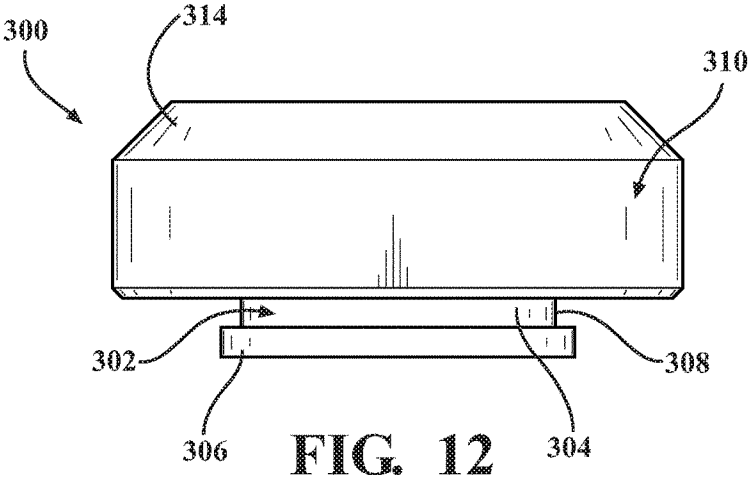
FIG. 12 shows a side view of the bowl element shown in FIG. 11.
Figure 13:
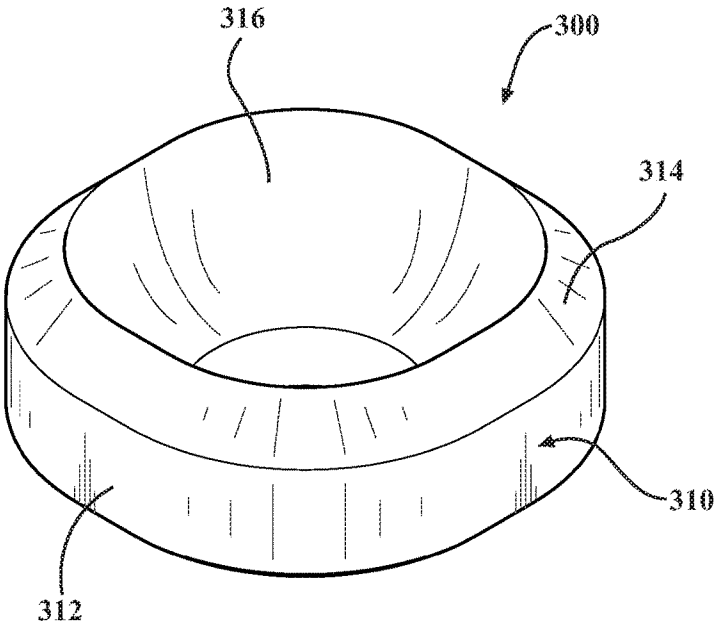
FIG. 13 shows a perspective view of the bowl element shown in FIG. 11.

As shown in FIGS. 11 through 13, a third alternative embodiment of the bowl device is generally shown at 300. The bowl device 300 includes a bottom portion, generally indicated at 302, having a central part 304 and a radial rim 306 extending outwardly from the central part 304 to define a radial notch 308 to secure the slide portion 16. A base plate, generally indicated at 310, has a side wall 312 and a concave top 314 extending further to an inner wall 316 inclined from the concave top 314 to a central inlet 318. As the opening 28 and the opening 76 are aligned with one another to receive the bowl device 300 secured there by as the slide portion 16 engages the radial notch 308 to secure the bowl device 300 therein during operating mode of the smoking pipe, i.e. the device 10.

The bowl device 300 is formed from metal but can be formed from other material without limiting the scope of the present invention. The base plate 310 presents a generally circular configuration but may also present a rectangular configuration. Uneven thickness of the base plate 310 is designed to manipulate and control temperature of the oil heated inside the bowl device 300. The base plate 310 may have even thickness as well without limiting the scope of the present invention. The bowl device 300 is formed from metal and can also be formed from other materials without limiting the scope of the present invention.

While the invention has been described with reference to an exemplary embodiment, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for smoking and vaporizing tobacco and inhalation materials comprising;

a body including a bottom portion, a core portion, and a slide portion;

a bowl connected to said body; and said bottom portion includes a bottom surface and a top surface wherein the width of said top surface is wider than the width of said bottom surface whereby said top surface further presents a pool defined therein to form a depth and a bottom of said pool, said pool presenting a first meshed surface comprised of a first multitude of cavities and a bottom surface of said core portion presenting a second meshed surface comprised of a second multitude of cavities with a channel defined in said core portion presenting a collector and a passage extending from said collector to complement with an outlet of said top surface of said bottom portion as said core portion covers said bottom portion to cover said pool thereby allowing a user to inhale fume as the fume is cooled while passing through said meshed surfaces of said pool and escaping through said channel;

said bowl includes a bottom portion having a central part and a radial rim extending outwardly from said central portion to define a radial notch to receive said slide portion; and wherein said central portion extends further to a base plate having a rectangular side and a concave top extending to a central tube portion with a plurality of rims of a circular configuration, whereby said opening of said slide portion and said opening of said core portion as aligned with one another receive said bowl secured by said slide portion engage said radial notch to secure said bowl therein during operating mode of said device.

2. The device as set forth in claim 1, wherein said slide portion presents a rectangular plate having a first end, a second end, side edges, and a pair of openings of said rectangular plate and formed at said first end, wherein said opening is used to receive said bowl.

3. The device as set forth in claim 1, wherein said bottom portion includes a first end, a second end, side edges, and side walls, said bottom portion presenting a rectangular configuration.

4. The device as set forth in claim 1, wherein said pool extends to an outlet defined at a first end of said bottom portion, said outlet presenting a semi-circular configuration.

5. The device as set forth in claim 1, wherein the width of said top surface is shorter than the width of said bottom surface whereby side walls are straight as they extend from said bottom surface and then incline as they extend to said top surface.

6. The device as set forth in claim 1, wherein said core portion includes a first end and a second end, a top surface of said core portion including a peripheral rail extending about said top surface except said first end of said core portion to allow said slide portion to be inserted therein and slide about said top surface wherein said opening defined in said slide portion and an opening defined in said core portion are aligned with one another to receive said bowl secured thereby.

7. The device as set forth in claim 6, including a metallic mesh fixedly secured within said opening of said core portion.

8. The device set forth in claim 1, including a bowl portion defined on the top of said central tube portion, said bowl portion formed by a peripheral side wall surrounding the end of said central tube portion wherein oils to be heated fill the voids defined between said peripheral side wall and said central portion extending to a central opening fluidly connected with said central portion to allow fumes to enter said device to be inhaled by the user.

9. The device as set forth in claim 1, wherein said bowl includes a bottom portion having a central part and a radial rim extending outwardly from said central part to define a radial notch to secure said slide portion.

10. The device as set forth in claim 9, wherein said bowl includes a base plate and a concave top extending to a central tube portion.

11. The device as set forth in claim 10, including a bowl portion defined on the top of said central tube portion, said bowl portion formed by a peripheral side wall surrounding end of said central tube portion wherein oils to be heated fill voids defined between said peripheral side wall and said central tube portion extending to a central opening fluidly connected with said central portion to allow fumes to enter said device to be inhaled by the user.

12. The device as set forth in claim 11, wherein said bowl presents a gradient thickness of sides wherein at least one of said sides is thicker than the other of said sides to manipulate and control temperature of the oil heated inside said bowl.

13. The device as set forth in claim 12, wherein said bowl is formed from at least one of metal, metal alloys, and heat resistant materials.

* * * * *